US006897812B2

(12) United States Patent
Huang

(10) Patent No.: US 6,897,812 B2
(45) Date of Patent: May 24, 2005

(54) DUAL-BAND ANTENNA

(75) Inventor: Chiao-Hsing Huang, Hsinchu Hsien (TW)

(73) Assignee: GemTek Technology Co., Ltd., Hsinchu (TW)

( * ) Notice: Subject to any disclaimer, the term of this patent is extended or adjusted under 35 U.S.C. 154(b) by 0 days.

(21) Appl. No.: 10/722,538

(22) Filed: Nov. 28, 2003

(65) Prior Publication Data

US 2004/0160368 A1 Aug. 19, 2004

(30) Foreign Application Priority Data

Feb. 18, 2003 (TW) ..... 92103345 A

(51) Int. Cl.[7] ..... H01Q 1/38

(52) U.S. Cl. ..... 343/700 MS; 343/841; 343/895

(58) Field of Search ..... 343/700 MS, 702, 343/741, 895

(56) References Cited

U.S. PATENT DOCUMENTS 4,899,164 A * 2/1990 McGrath ..... 343/754
6,639,558 B2 * 10/2003 Kellerman et al. .. 343/700 MS
6,664,931 B1 * 12/2003 Nguyen et al. ..... 343/767
6,809,688 B2 * 10/2004 Yamada ..... 343/700 MS
2003/0080904 A1 * 5/2003 Chen ..... 343/700 MS

* cited by examiner

*Primary Examiner*—Tan Ho
(74) *Attorney, Agent, or Firm*—Troxell Law Office, PLLC

(57) ABSTRACT

A dual-band antenna includes a multi-layer substrate and metal strips formed on different layers of the multi-layer substrate. The multi-layer substrate includes at least a first substrate and a second substrate. The metal strips include a first metal strip, a second metal strip, and a sleeve structure. The first metal strip formed on the first substrate further includes a first feeding end and a first open circuit end. The second metal strip formed on the second substrate further including a second feeding end, a vortical metal structure and a second open circuit end, wherein the second feeding end connects the first metal strip through a first conductive via. The sleeve structure formed on the multi-layer substrate by skirting the first metal strip is electrically isolated. By providing the dual-band antenna, a first frequency can be resonated by the strip between the first feeding end and the second open circuit end, and also a second frequency can be resonated by the strip between the first feeding end and the first open circuit end. Additionally, by providing the sleeve structure, the transmission bandwidth for the second frequency can be increased.

14 Claims, 6 Drawing Sheets

DUAL-BAND ANTENNA

BACKGROUND OF THE INVENTION (1) Field of the Invention

The invention relates to a dual-band antenna, and more particularly to a wideband design of dual-band antenna.

(2) Description of the Prior Art

Rapid innovation and development upon wireless communication technology have made mobile communication products as one of the mainstream products nowadays. These mobile communication products include mobile phones, PDAs, notebooks, etc. For sharing resources and transmitting data, they can couple with proper communication modules for linking by wiring or wirelessly with a Local Area Network (LAN) to transmit and receive e-mail and to receive instant information such as news, stocks quotations, and so on.

For instance, in atypical wireless local area network (WLAN), the operating frequency is used to locate in ISM (Industrial Scientific Medical)2.4 GHz. The ISM Band such as a blue tooth system and the group of IEEE 802 standard are widely adopted in radio communication equipments. Hence, the interference problems such as co-channel interference and/or next-channel interference are serious enough so that a trend of using another higher frequency band (say, 5.725~5.85 GHz) has been gradually merged.

In the art, the flat inverted-F antennas have advantages of slim size and lightweight, and thus have been widely adopted as built-in antennas in most of the mobile communication products. Referring to FIG. 1 for a conventional compact printed antenna, the antenna includes a substrate 10, a ground metal 11, a strip metal 12, a short circuit leg 14 and a feeding leg 16; in which the ground metal 11, the strip metal 12, the short circuit leg 14 and the feeding leg 16 are all printed circuits located on the substrate 10. The feeding leg 16 is formed by bifurcating the metal strip 12 to reach electrically a matching circuit (not shown in the drawing). The feeding leg 16 and the ground metal 11 are not connected with each other so as to avoid a short circuit problem. The strip metal 12 is parallel with the ground metal 11. The short circuit leg 14 is located at one end (connecting a short circuit end 18) of the strip metal 12 and extends further to connect with the ground metal 11 so as to form an open circuit-short circuit structure with another end (an open circuit end 19) of the strip metal 12. The distance between the open circuit end 19 and the short circuit end 18 is preferably one quarter of the wavelength.

In order to transmit and receive signals at dual-band frequency, a constant range of one quarter of the wavelength at a lower operating frequency is the only requirement to be satisfied theoretically. In fact, the operating frequency of the aforementioned compact printed antenna is limited to single frequency band. It must be pointed out that the resonance frequency of the compact printed antenna is usually located between 8 GHz and 9 GHz which is already beyond the contemporary radio communication standard and thus will cause a serious problem in return loss Therefore, improvement upon multi-frequency operable bands is definitely needed.

SUMMARY OF THE INVENTION

Accordingly, it is one object of the present invention to provide a dual-band antenna which can transmit/receive at proper frequency bands and also has an increased transmission bandwidth.

It is another object of the present invention to provide a dual-band antenna which has a shrunk size to fit into a smaller communication device.

It is one more object of the present invention to provide a dual-band antenna with a sleeve structure which increases the bandwidth at the higher second frequency promoting the freedom of transmitting and receiving signals through the antenna.

In one embodiment of the present invention, the dual-band antenna can include a multi-layer substrate and metal strips formed on different layers of the multi-layer substrate. The multi-layer substrate can include at least a first substrate and a second substrate. The metal strips can include a first metal strip and a second metal strip. The first metal strip is formed on the first substrate and further includes a first feeding end and a first open circuit end. The second metal strip formed on the second substrate further includes a second feeding end, a vortical metal structure and a second open circuit end, wherein the second feeding end connects the first metal strip through a first conductive aperture. By providing the equivalent current path length to be one quarter of the wavelength for the lower frequency and the vortical metal configuration to generate an inductance for enabling the antenna to operate at dual-band frequency, a first frequency will be resonated by the strip through the construction between the first feeding end and the second open circuit end, and a second frequency will be resonated by the strip through the construction between the first feeding end and the first open circuit end.

In one embodiment of the present invention, a sleeve structure can be further added. The sleeve structure can include a first metal layer, a second metal layer, a third metal layer, and a fourth metal layer. The first metal layer is formed on a third substrate. The second metal layer is formed on a lateral surface of the multi-layer substrate and connects electrically with the first metal layer. The third metal layer is formed on the third substrate. The fourth metal layer is formed on another lateral surface opposite to the second metal layer of the multi-layer substrate and connects electrically with the third metal layer. By including the sleeve structure, the transmission bandwidth for the higher second frequency can then be increased.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is to provide a dual-band antenna which can transmit and receive a first frequency signal and a second frequency signal, besides, increase the bandwidth of the higher second frequency so that promoting the freedom of communicating at higher frequency band. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
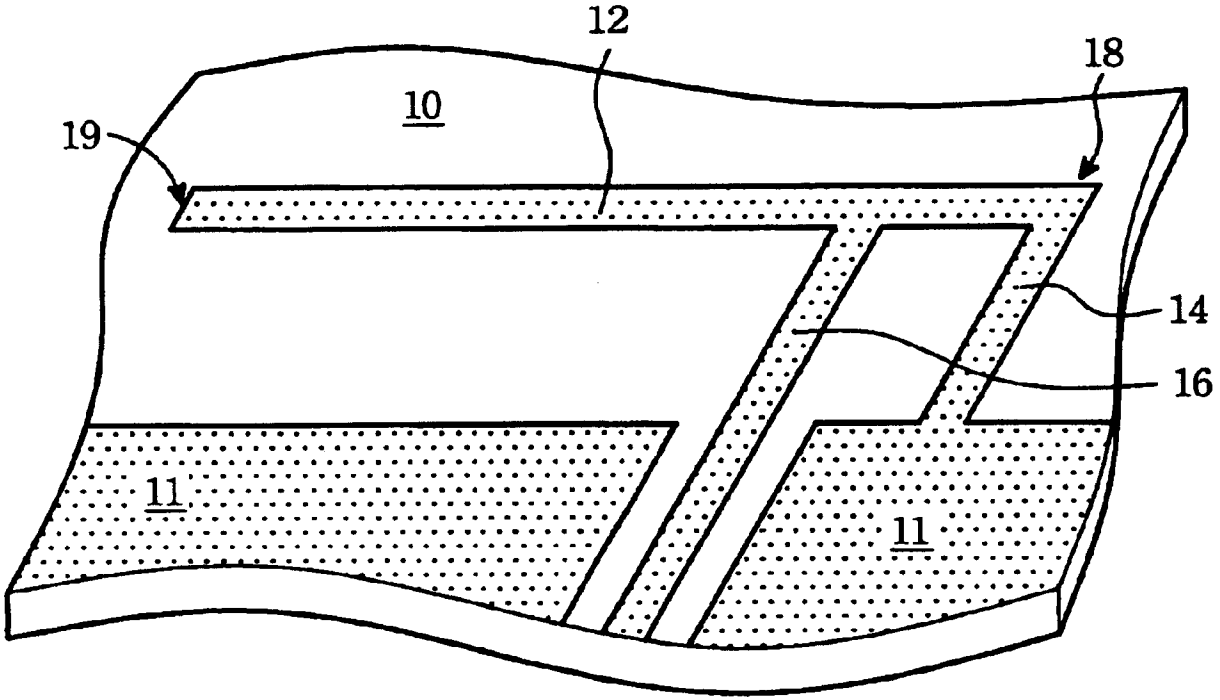
FIG. 1 (Prior Art)
FIG. 1 is a schematic view of a conventional single frequency band antenna.
Figure 2:
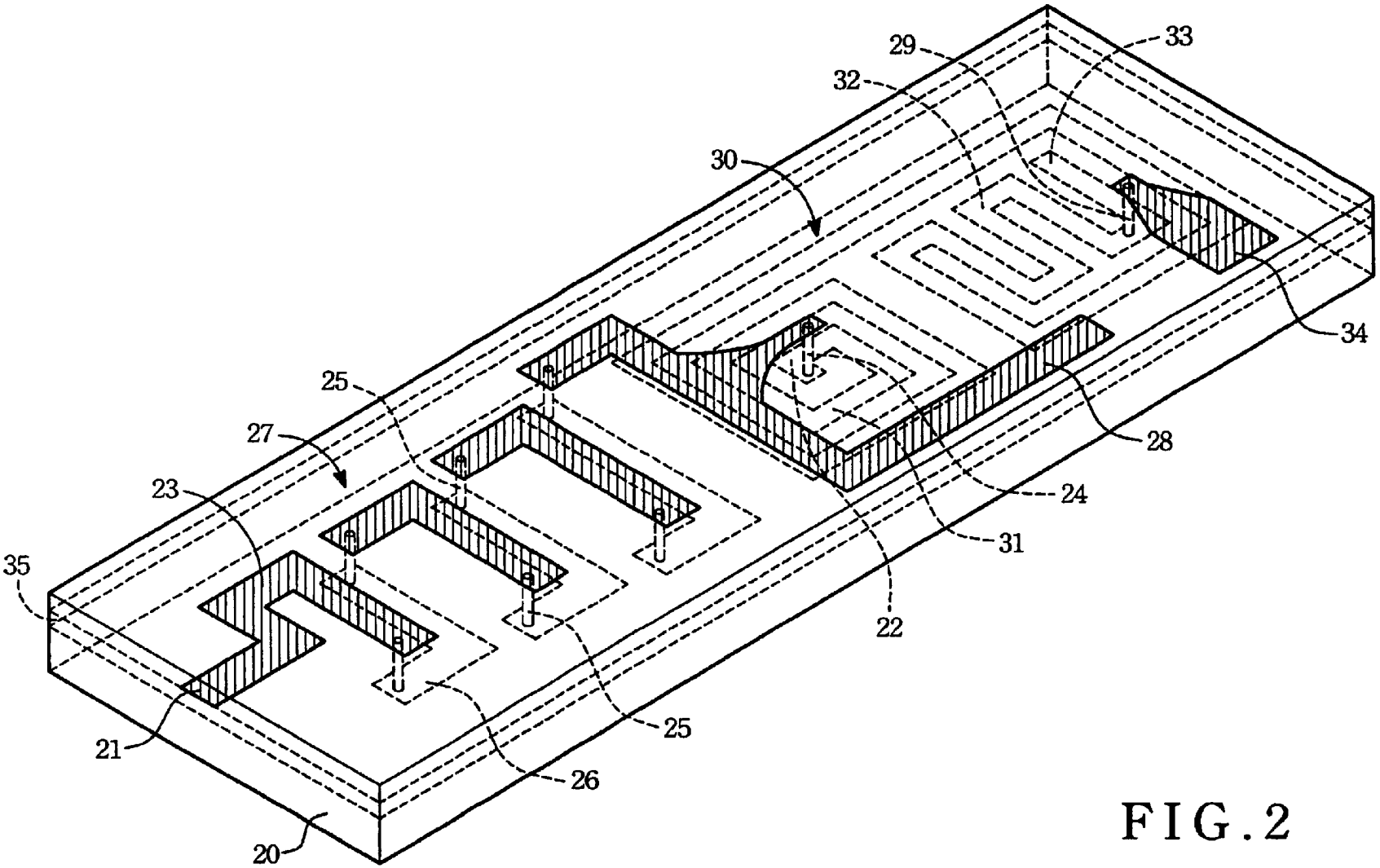
FIG. 2 is a perspective view of a first embodiment of the dual-band antenna in accordance with the present invention.

Referring to FIG. 2 for a first embodiment of the present invention, the dual-band antenna includes a multi-layer substrate 20, a first metal strip 27, and a second metal strip 30. In the first embodiment, a material of the Low-Temperature Cofired Ceramics (LTCC) can be preferably adopted for the multi-layer substrate 20. In the art, the LTCC substrate 20 can be integrated by laminating a plurality of ceramic layers under a firing temperature between 850° C. and 900° C., in which each ceramic layer carries respective printed circuiting. Definitely, in another embodiment of the present invention, the material of the multi-layer substrate 20 can also be chosen from multi-layer print circuit boards such as FR-4, FR-5, PTFE, etc.

Figure 3:
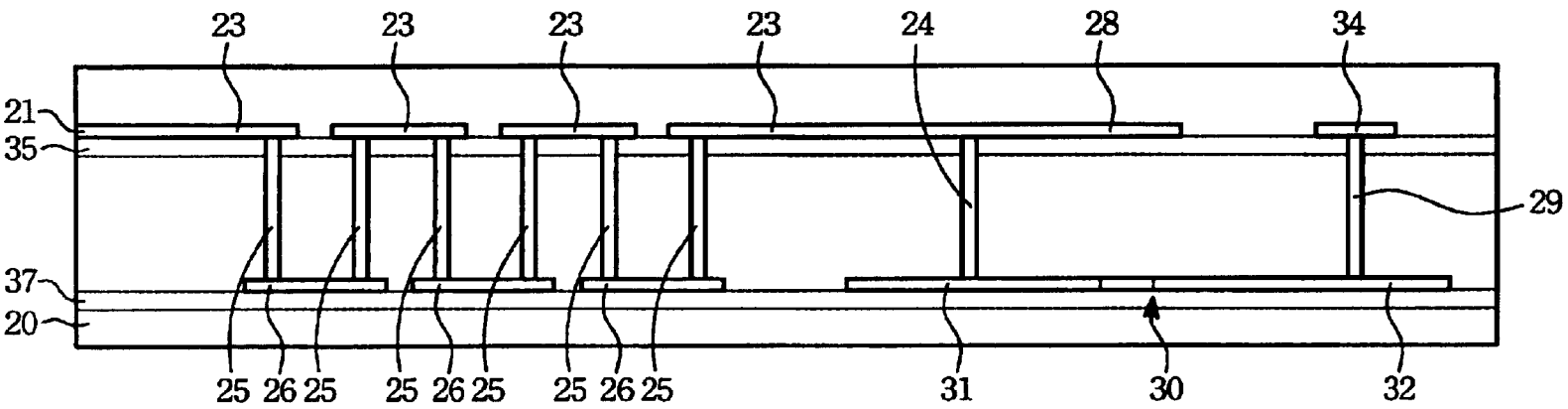
FIG. 3 is a side view of the dual-band antenna of FIG. 2.

Meanwhile, referring also to FIG. 3, it is a side view of the first embodiment. It should be noted that the multi-layer substrate 20 can include at least two substrates, a first substrate 35 and a second substrate 37, to define the metal strip configuration for the antenna according to the present invention. The first metal strip 27 bridging electrically the first substrate 35 and the second substrate 37 can include a plurality of upper metal strips 23 and a plurality of lower metal strips 26, respectively formed on the first substrate 35 and the second substrate 37. As shown, the upper metal strips 23 and the lower metal strips 26 are interconnected by respective second conductive vias 25. By providing the second conductive vias 25, the first metal strip 27 can then be shaped as a relief undulant configuration. Besides, the first metal strip 27 further includes a first feeding end 21 and a first open circuit end 28. The first feeding end 21 is used to connect a feeding circuit (not shown in the drawing).

In the present invention, the distance between the first feeding end 21 and the first open circuit end 28 of the antenna is preferably one quarter of the wavelength (for the higher second frequency band) that is the equivalent current path length of the open circuit-short circuit oscillation signal. Thereby, the antenna can transmit and receive signals at a higher second frequency band (mostly 5 to 6 GHz). Besides, under the condition that the equivalent current path length equals to one quarter of the wavelength, the linear distance between the first feeding end 21 and the first open circuit end 28 of the relief undulant configuration can be shortened. Additionally, in the present invention, the first metal strip 27 can be made on the same layer of ceramic substrate and, that is, the shape of the metal strip 27 will not limited to the undulant type described above. However, all the modifications upon shaping the first metal strip 27 are well known to the skilled person in the art and, definitely, any intent to include such a modification shall be within the scope of this invention.

The second metal strip 30, formed on the second substrate 37, includes a vortical metal structure 31 and an undulant metal structure 32 and further includes a second feeding end 22 and a second open circuit end 33. The second feeding end 22 connects the first metal strip 25 through a first conductive via 24. The vortical metal structure 31 will generate inductance that can extend the equivalent wavelength of the higher second frequency and effectively lower the operational frequency through increasing the number of vortex of the vortical metal structure 31. Preferably, an open circuit strip 34 can be formed on the first substrate 35. The open circuit strip 34 connects the undulant metal structure 32 with a third conductive via 29. The vortical metal structure 31, the undulant metal structure 32 and the aforementioned metal strips can be formed as screen printing circuits located on the ceramic substrate. Besides, the vortical metal structure 31 and the undulant metal structure 32 can be separately made on different layers of ceramic substrate and the shape of the undulant metal structure 32 will not be limited to the undulant type. That is, all such modifications intended to be included are within the scope of this invention.

The distance between the first feeding end 21 and the second open circuit end 33 (or the open circuit strip 34) of the antenna is preferably one quarter of the wavelength (for the lower first frequency band) that is the equivalent current path length of the open circuit-short circuit oscillation signal. Thereby, the antenna can transmit and receive signals at a lower first frequency band (mostly at 2.4 GHz). Upon such an arrangement, the linear distance under the bending configuration of the undulant metal structure 32 or the vortical metal structure 31 can be shortened.

In summary, the lower first frequency band will be resonated by the first metal strip 27, and the higher second frequency band will be resonated by the combination of the first metal strip 27 and the second metal strip 30. Thereby, the antenna of the present invention can transmit and receive signals at dual-band frequency.

Figure 4:
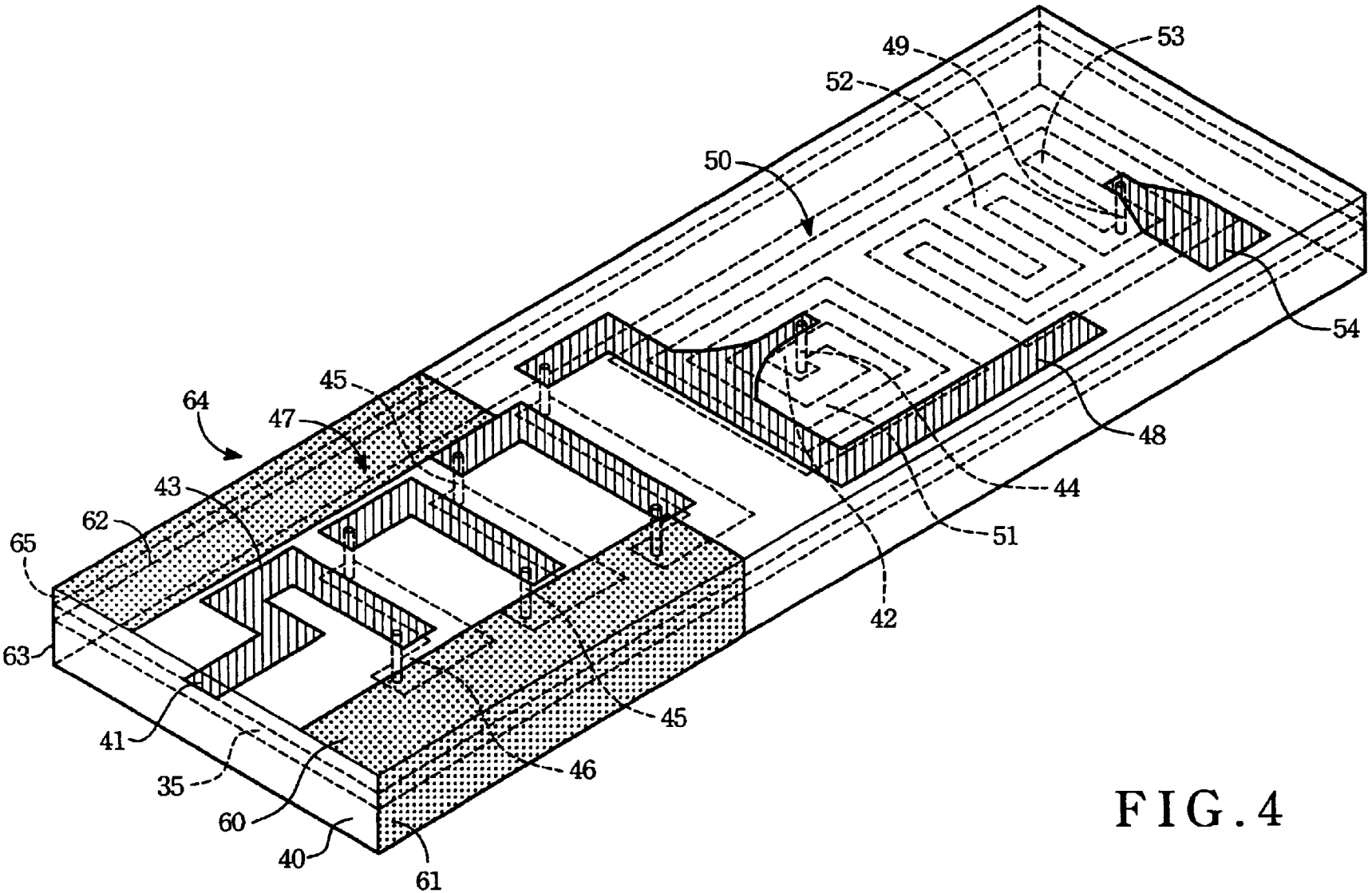
FIG. 4 is a perspective view of a second embodiment of the dual-band antenna in accordance with the present invention.
Figure 5:
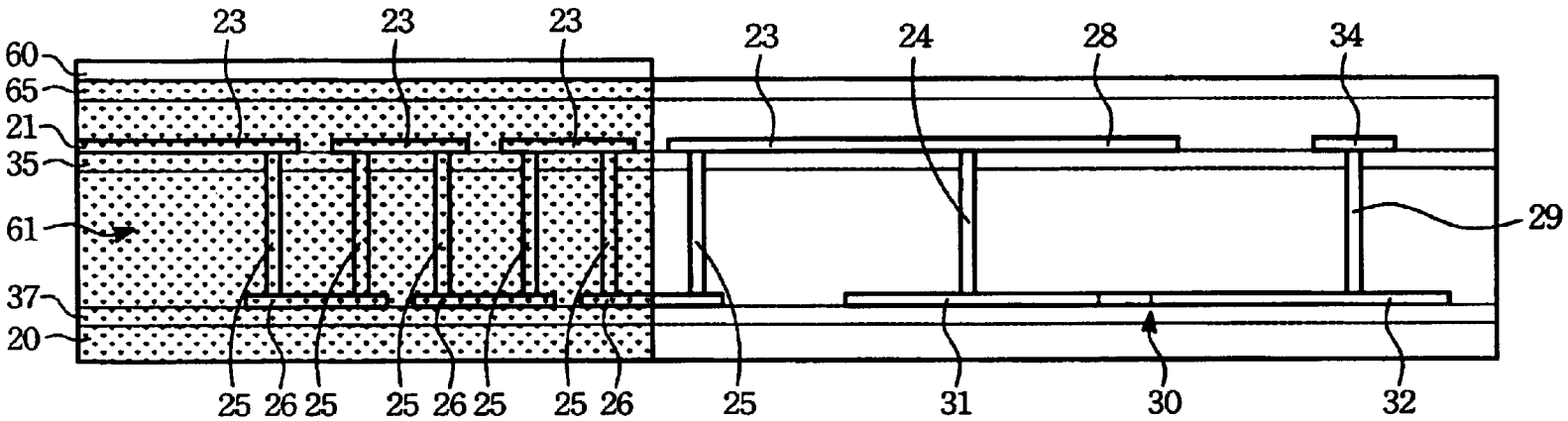
FIG. 5 is a side view of the dual-band antenna of FIG. 4.

Referring now to FIG. 4 and FIG. 5 for a second embodiment of the present invention, the dual-band antenna includes a multi-layer substrate 40, a first metal strip 47, a second metal strip 50 and a sleeve structure 64. Different to the first embodiment of the present invention, the added sleeve structure 64 of the second embodiment includes a first metal layer 60, a second metal layer 61, a third metal layer 62 and a fourth metal layer 63. The first metal layer 60 and the third metal layer 62 are separately formed on the third substrate 65 of the multi-layer substrate 40. It should be noted that the sleeve structure 64 would not connect electrically with the first metal strip 47 and the second metal strip 50. Meanwhile referring to FIG. 5, the second metal layer 61 is formed on a side of the multi-layer substrate 40 and connects electrically with the first metal layer 60. The fourth metal layer 63 is formed on the other side opposite to the second metal layer 61 of the multi-layer substrate 40 and connects electrically with the third metal layer 62. The first metal strip 47, the second metal strip 50, and the sleeve structure 64 are formed as screen printing circuits located on the ceramic substrate.

In the present invention, the sleeve structure 64 extends from the first feeding end 41 to a place which is one third to two thirds of the linear length of the first metal strip 47 and skirting the first metal strip 47. It should be noted that the sleeve structure 46 will be grounded without connection with any metal strip. In operation of the second embodiment with the sleeve structure 64, the current distribution will not vary too much with the variation of the operating frequency so that the impedance will be stable enough to result in a wideband operation. As a consequence, the bandwidth for the higher second frequency resonated by the first metal strip 47 can be increased as well.

Figure 6:
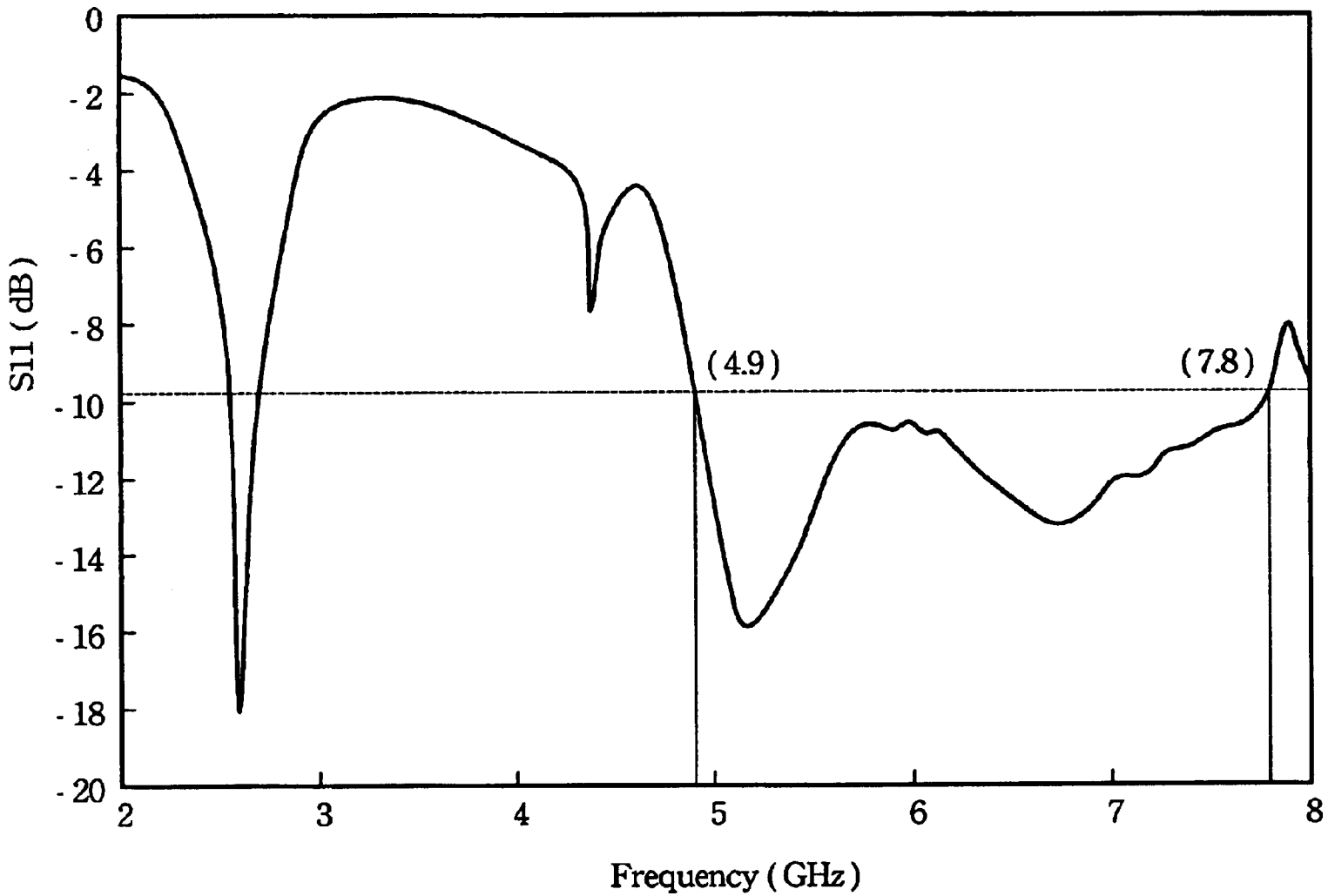
FIG. 6 is a diagram of computer-simulation results illustrating the input return loss versus frequency for the antenna of FIG. 4.

Referring to FIG. 6, a diagram of computer-simulation results illustrating the input return loss (S11) versus frequency for the antenna according to the second embodiment of the present invention is shown. It should be noted that, under the condition of S11<−10 dB, the operable bandwidth is about 80 MHz for the lower first frequency band (mostly at 2.4 GHz) while the higher second frequency band covers from 4.9 to 7.8 GHz. Thereby, the operable range of the antenna can then cover various radio communication standards at different places and thus increase the convenience for transmitting and receiving signals of one antenna.

In summary, the dual-band antenna of the present invention provides at least the following advantages over the conventional techniques:

(1) The bending configuration of the first metal strip and the flat bending configuration of the second metal strip can shrink the size of the antenna.

(2) The vortical configuration of the second metal strip generates inductance and effectively reduces the wavelength for the higher frequency band that the antenna of the present invention can thereby transmit/receive signals at a dual frequency band.

(3) The sleeve structure increases the bandwidth at the higher second frequency so that the freedom of transmitting and receiving signals through the antenna can be promoted.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as will as other embodiments, are intended to be included within the scope of the appended claims. The invention is defined by the following claims, with equivalents of the claims to be included therein.

I claim:

1. A dual-band antenna providing signals for proceeding radio communication at a first frequency and a second frequency, comprising:

a multi-layer substrate, which includes at least a first substrate and a second substrate;

a first metal strip, which is formed on said first substrate and further includes a first feeding end and a first open circuit end;

a second metal strip, which is formed on said second substrate and further includes a second feeding end, a vortical metal structure and a second open circuit end, wherein said second feeding end connects said first metal strip through a first conductive via; and a sleeve structure, which is formed on said multi-layer substrate by skirting said first metal strip for increasing the bandwidth of said second frequency;

wherein said first frequency is resonated by the strip between said first feeding end and said second open circuit end, and said second frequency is resonated by the strip between said first feeding end and said first open circuit end.

2. The dual-band antenna of claim 1, wherein an equivalent current path length of said first feeding end and said first open circuit end to form an open circuit-short circuit structure is one quarter of a selected wavelength.

3. The dual-band antenna of claim 1, wherein said second metal strip further comprises an undulant metal structure.

4. The dual-band antenna of claim 1, wherein an equivalent current path length of said first feeding end and said second open circuit end to form an open circuit-short circuit structure is one quarter of a selected wavelength.

5. The dual-band antenna of claim 1, wherein said multi-layer substrate further comprises a third substrate and said sleeve structure further comprises:

a first metal layer, which is formed on said third substrate;

a second metal layer, which is formed on a lateral surface of said multi-layer substrate and connects electrically with said first metal layer;

a third metal layer, which is formed on said third substrate; and a fourth metal layer, which is formed on another lateral surface opposite to said second metal layer of said multi-layer substrate and connects electrically with said third metal layer.

6. The dual-band antenna of claim 1, wherein a length of said sleeve structure is one third to two thirds of a linear length of said first metal strip.

7. A dual-band antenna providing signals for proceeding radio communication at a first frequency and a second frequency, comprising:

a multi-layer substrate, which includes at least a first substrate and a second substrate;

a first metal strip, including a plurality of upper metal strips formed on said first substrate, a plurality of lower metal strips formed on said second substrate, a first feeding end, and a first open circuit end; and a second metal strip, which is formed on said second substrate and further includes a second feeding end, a vortical metal structure and a second open circuit end, wherein said second feeding end connects said first metal strip through a first conductive via;

wherein said first frequency is resonated by the strip between said first feeding end and said second open circuit end, and said second frequency is resonated by the strip between said first feeding end and said first open circuit end.

8. The dual-band antenna of claim 7, further comprising a sleeve structure formed on said multi-layer substrate by skirting said first metal strip.

9. The dual-band antenna of claim 8, wherein said multi-layer substrate further comprises a third substrate and said sleeve structure further comprises:

a first metal layer, which is formed on said third substrate;

a second metal layer, which is formed on a lateral surface of said multi-layer substrate and connects electrically with said first metal layer;

a third metal layer, which is formed on said third substrate; and a fourth metal layer, which is formed on another lateral side surface opposite to said second metal layer of said multi-layer substrate and connects electrically with said third metal layer.

10. The dual-band antenna of claim 8, wherein a length of said sleeve structure is one third to two thirds of a linear length of said first metal strip.

11. The dual-band antenna of claim 7, wherein an equivalent current path length of said first feeding end and said first open circuit end to form an open circuit-short circuit structure is one quarter of a selected wavelength.

12. The dual-band antenna of claim 7, wherein said upper metal strips connect said lower metal strips through a plurality of second conductive vias.

13. The dual-band antenna of claim 7, wherein said second metal strip further comprises an undulant metal structure.

14. The dual-band antenna of claim 7, wherein an equivalent current path length of said first feeding end and said second open circuit end to form an open circuit-short circuit structure is one quarter of a selected wavelength.

* * * * *